US011670318B2

(12) United States Patent
Klimanis

(10) Patent No.: US 11,670,318 B2
(45) Date of Patent: Jun. 6, 2023

(54) APPARATUS AND METHOD FOR ACOUSTIC ECHO CANCELLATION WITH OCCLUDED VOICE SENSOR

(71) Applicant: DSP Concepts, Inc., Santa Clara, CA (US)

(72) Inventor: Gints Klimanis, Cupertino, CA (US)

(73) Assignee: DSP Concepts, Inc., Santa Clara, CA (US)

( * ) Notice: Subject to any disclaimer, the term of this patent is extended or adjusted under 35 U.S.C. 154(b) by 48 days.

(21) Appl. No.: 17/321,238

(22) Filed: May 14, 2021

(65) Prior Publication Data

US 2022/0366925 A1 Nov. 17, 2022

(51) Int. Cl.
*G10L 21/0208* (2013.01)
*H04R 3/00* (2006.01)

(52) U.S. Cl.
CPC *G10L 21/0208* (2013.01); *G10L 2021/02082* (2013.01); *G10L 2021/02087* (2013.01)

(58) Field of Classification Search
CPC ..... G10L 21/0208; G10L 2021/02082; G10L 2021/02087; G10L 25/78; G10L 25/84; H04R 1/1083; H04R 1/1016; H04R 1/10; H04R 1/28; H04R 5/033; H04R 25/00; H04R 25/554; H04R 25/453; H04R 25/405; H04R 25/505; H04R 3/005; A61B 5/0022; A61B 5/0006; H04M 9/082
USPC ..... 704/226, 205, 206, 207, 208, 220, 225, 704/19.014, 21.002, 21.004, 21.007; 381/17, 18, 19, 20, 21, 74, 300, 301, 302, 381/303, 307, 119, 66, 27, 7, 1.1–71.6, 381/71.9, 71.11, 71.12, 26, 318, 86, 92, 381/94.1, 93, 95, 9, 6, 122, 123, 151, 381/312, 98–103; 379/406.01–406.16; 455/569.1, 570; 700/94
See application file for complete search history.

(56) References Cited

U.S. PATENT DOCUMENTS

| | | | | |
|---|---|---|---|---|
| 5,933,506 | A * | 8/1999 | Aoki | H04R 3/005 381/94.1 |
| 2010/0020984 | A1* | 1/2010 | Janse | H04R 3/02 381/119 |
| 2014/0072135 | A1* | 3/2014 | Bajic | G10K 11/17854 381/71.11 |
| 2014/0286498 | A1* | 9/2014 | Sudo | H04R 3/002 381/66 |
| 2020/0212601 | A1* | 7/2020 | Gorcea | H01Q 1/273 |

* cited by examiner

*Primary Examiner* — Leshui Zhang
(74) *Attorney, Agent, or Firm* — Schwegman Lundberg & Woessner, P.A.

(57) ABSTRACT

An apparatus and method for auto echo cancellation utilizing an occluded voice sensor. The technology as disclosed and claimed herein and the various implementations and embodiments improves Acoustic Echo Cancellation (AEC) system performance by increasing cancellation quality and speech SNR by the replacement of the lower frequency portion of the microphone signal with the signal of an Occluded Voice Sensor (OVS) signal and never including the spectral band in the transmission. This frequency band replacement excludes the reinjection of that band from the speaker.

18 Claims, 4 Drawing Sheets

APPARATUS AND METHOD FOR ACOUSTIC ECHO CANCELLATION WITH OCCLUDED VOICE SENSOR

BACKGROUND

FIELD: This technology as disclosed herein relates generally to acoustic echo cancellation (AEC) and, more particularly, to AEC for audio wearables.

BACKGROUND OF ART: It is common for audio wearables to be configured with a speaker that is very close to the microphone, for instance, this is not uncommon for certain earbud designs. Also, the microphone may be exposed to random audible environmental noise our sounds. These common configurations in combination with the often used low-distortion speakers may inhibit good acoustic echo cancellation.

A better apparatus and/or method is needed for improving acoustic echo cancellation for audio wearables.

SUMMARY

The technology as disclosed herein includes a method and apparatus for auto echo cancellation utilizing an occluded voice sensor. Some audio wearable technologies have one or more additional sensors to capture the occluded voice. Some headphones have such a sensor, such as an ear-cup microphone used in Feedback Active Noise Cancellation, however, greater occlusion of the ear is needed for that microphone to be an occluded voice sensor. The technology as disclosed and claimed herein utilizes a device that is tightly coupled to the ear or chest or other body-conducted voice conduction area such that a body conducted voice signal is collected, and the occluded voice sensor is acoustically shielded and acoustically isolated from environmental noise emanating from an ambient acoustical area surrounding the body conduction area such that adequate Signal-to-Noise Ratio (SNR) is achieve. The technology as disclosed and claimed herein and the various implementations and embodiments improves Acoustic Echo Cancellation (AEC) system performance by increasing cancellation quality and speech signal-to-noise ration (SNR) by the replacement of the lower frequency portion of the microphone signal with the signal of an Occluded Voice Sensor (OVS) signal and never including the spectral band in the transmission. This frequency band replacement excludes the reinjection of that band from the speaker.

The Occluded Voice Sensor (OVS) collects body-conducted voice instead of open-air voice, which tends to be in a lower frequency band that will be called the Occluded Voice Sensor Band (OVS Band). Typically, the body itself limits the conduction of voice signals above 700 Hz or so. But in the case of an ear canal microphone at the tip of the stem of an Ear Bud, the OVS Band may extend to 2000 Hz or higher. For one implementation the OVS band extends to 2500 Hz.

There are various OVS implementations including a 1-D or 3D accelerometer in an Ear Bud, for example, that collects body-conducted voice signals from the ear canal's surface or in a Neck Band that collects body-conducted voice from the surface of the torso of a wearer of the audio wearable device. One implementation of a OVS includes a miniature microphone in a Closed-Back Headphone's Ear Cups or tight-fit Ear Bud's stem that collects the body-conducted voice that leaks into the air enclosed in the ear canal. For these various implementations, the OVS signal is shielded from environmental noise to the amount of the acoustic isolation of its enclosure, including noise generated by wind turbulence at the microphone ports. However, the OVS sensor still receives the noise that vibrates the enclosure—which is usually lower frequency noise. Another implementation of the OVS sensor is an ear canal microphone located at the tip of the stem of the Ear Bud in a fully occluded Earbud with a tight-fit or occluded-fit. This seal in an ear canal microphone, for one implementation, provides about 25 dBA attenuation above approximately 300 Hz, and more attenuation at higher frequencies. In an Ear Bud, this OVS signal is shielded from the environment by the ear anatomy and the EarBud enclosure.

The speech transmission path is directly improved by the replacement of a portion of the air-conducted voice signal from the outward-facing microphones with the noise-shielded OVS signal. The OVS signal occupies the OVS Band of the speech transmission channel while the air-conducted signal occupies the channel above the OVS Band. The OVS is shielded from environmental noise, including far-end speech from the nearby speaker driver, so the AEC path then does not include components in the OVS Band. For one implementation, the AEC algorithm/module is configured to operate above 1000 Hz only. Since the AEC path bandwidth is reduced by elimination of the possibility to recirculate the OVS band, the voice transmission quality and the AEC quality is improved.

For one implementation, an OVS is used to confirm the presence of user's "local voice" to freeze/unfreeze Acoustic Echo Cancellation (AEC) adaptation in double-talk or full duplex communication situations where the near-end and far-end users are speaking at the same time. Acoustic echo cancellers (AEC) are used in full-duplex hands-free communication systems in which the far-end (loudspeaker) signal is coupled with the near-end (microphone) signal. AECs are used to remove the unwanted echoes from the transmission path. Cancellation of these echoes is a system identification signal processing problem. In this situation the microphone signal is considered the desired signal and the loudspeaker signal is the excitation signal. An adaptive filter algorithm modifies the filter coefficients, so when it is convolved with the excitation signal, it's output matches that of the microphone signal.

The difference between the near-end signal and the filter output is used as the criteria for updating the filter coefficients. In a full-duplex conversation, the presence of signals other than the far-end signal convolved with the echo path, inhibit the ability of the adaptive algorithm to model the system. Ambient noise provides a theoretical bound on the achievable cancellation of the system. The presence of the near-end talker during far-end speech is a source of disruption in the adaptation of the filter. Therefore, adaptation of the filter must be prevented during this double-talk (DT) scenario via a double-talk detector. This ensures that environmental speech is not confused with local speech. When the OVS is utilized to confirm the presence of a user's "local voice" the detection causes the system to adapt thereby reducing the system's AEC path bandwidth by OVS Band. As a result, system components such as the speaker driver can be designed with less stringent distortion requirements at the lowest voice frequencies, which often results in a smaller, lower cost driver.

Since the OVS can help detect a wearer's voice while also rejecting nearby voices in the environment, the Double Talk condition can be identified more reliably with an OVS Voice Activity Detector (VAD) used instead or in combination with a DSP VAD. Since the OVS Band of the speaker's signal is not included in the Near-End talker's microphone's output signal, the distortion specifications e.g. THD of the speaker driver can be relaxed. If an audio wearable has an OVS, the technology as disclosed and claimed can run as a DSP software-only feature. The Occluded Voice Sensor (OVS) reduces a system's AEC path bandwidth in the OVS Band. As a result, system components such as the speaker driver can be designed with less stringent distortion requirements. Preferably the technology provides maximum occlusion of the ear microphone in the case of an ear canal microphone located on the stem of the Ear Bud. Preferably the ear sensor device is tightly coupled to the ear or chest such that the body-conducted voice has adequate Signal-to-Noise Ratio.

The OVS signal is shielded from environmental noise to the amount of the acoustic isolation of its enclosure, including noise generated by wind turbulence at the microphone ports. However, the OVS sensor still receives the noise that vibrates the enclosure—usually lower frequency noise. The speech transmission path is directly improved by the replacement of a portion of the air-conducted voice signal from the outward-facing microphones with the noise-shielded OVS signal. The OVS signal occupies the OVS Band of the speech transmission channel while the air-conducted signal occupies the channel above the OVS Band. The OVS is shielded from environmental noise, including far-end speech from the nearby speaker driver, so the AEC transmission path then does not include components in the OVS band. The AEC algorithm selectively operates above the OVS Band. Since the AEC path bandwidth is reduced, the AEC quality is improved.

The features, functions, and advantages that have been discussed can be achieved independently in various implementations or may be combined in yet other implementations further details of which can be seen with reference to the following description and drawings.

These and other advantageous features of the present technology as disclosed will be in part apparent and in part pointed out herein below.

BRIEF DESCRIPTION OF THE DRAWING

For a better understanding of the present technology as disclosed, reference may be made to the accompanying drawings in which.

Figure 1A:
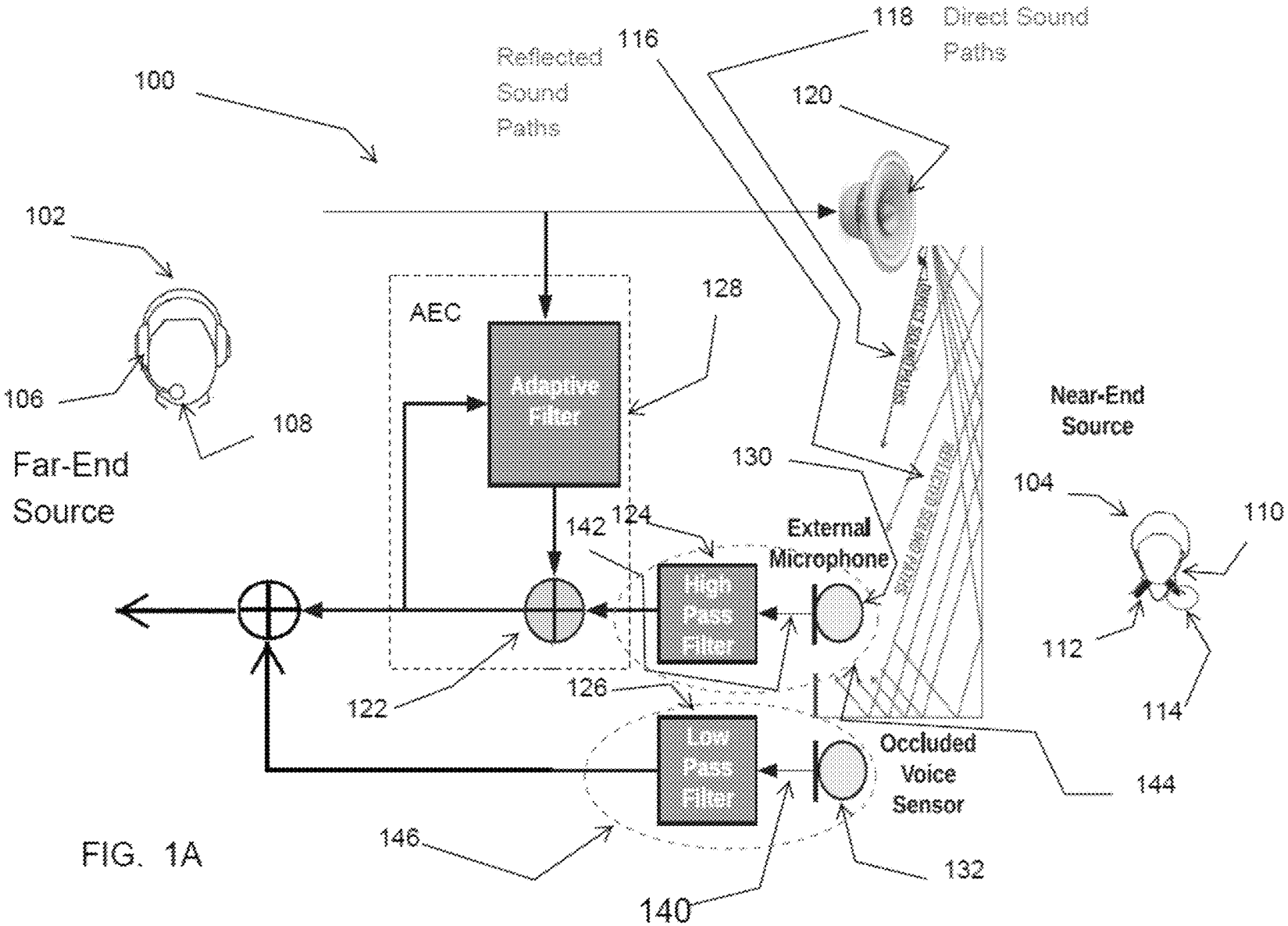
FIG. 1A is an illustration of an AEC utilizing an OVS.

While the technology as disclosed is susceptible to various modifications and alternative forms, specific implementations thereof are shown by way of example in the drawings and will herein be described in detail. It should be understood, however, that the drawings and detailed description presented herein are not intended to limit the disclosure to the particular implementations as disclosed, but on the contrary, the intention is to cover all modifications, equivalents, and alternatives falling within the scope of the present technology as disclosed and as defined by the appended claims.

DESCRIPTION

According to the implementation(s) of the present technology as disclosed, various views are illustrated in FIG. 1 and like reference numerals are being used consistently throughout to refer to like and corresponding parts of the technology for all of the various views and figures of the drawing. Also, please note that the first digit(s) of the reference number for a given item or part of the technology should correspond to the Fig. number in which the item or part is first identified. Reference in the specification to "one embodiment" or "an embodiment"; "one implementation" or "an implementation" means that a particular feature, structure, or characteristic described in connection with the embodiment or implementation is included in at least one embodiment or implementation of the invention. The appearances of the phrase "in one embodiment" or "in one implementation" in various places in the specification are not necessarily all referring to the same embodiment or the same implementation, nor are separate or alternative embodiments or implementations mutually exclusive of other embodiments or implementations.

Figure 1B:
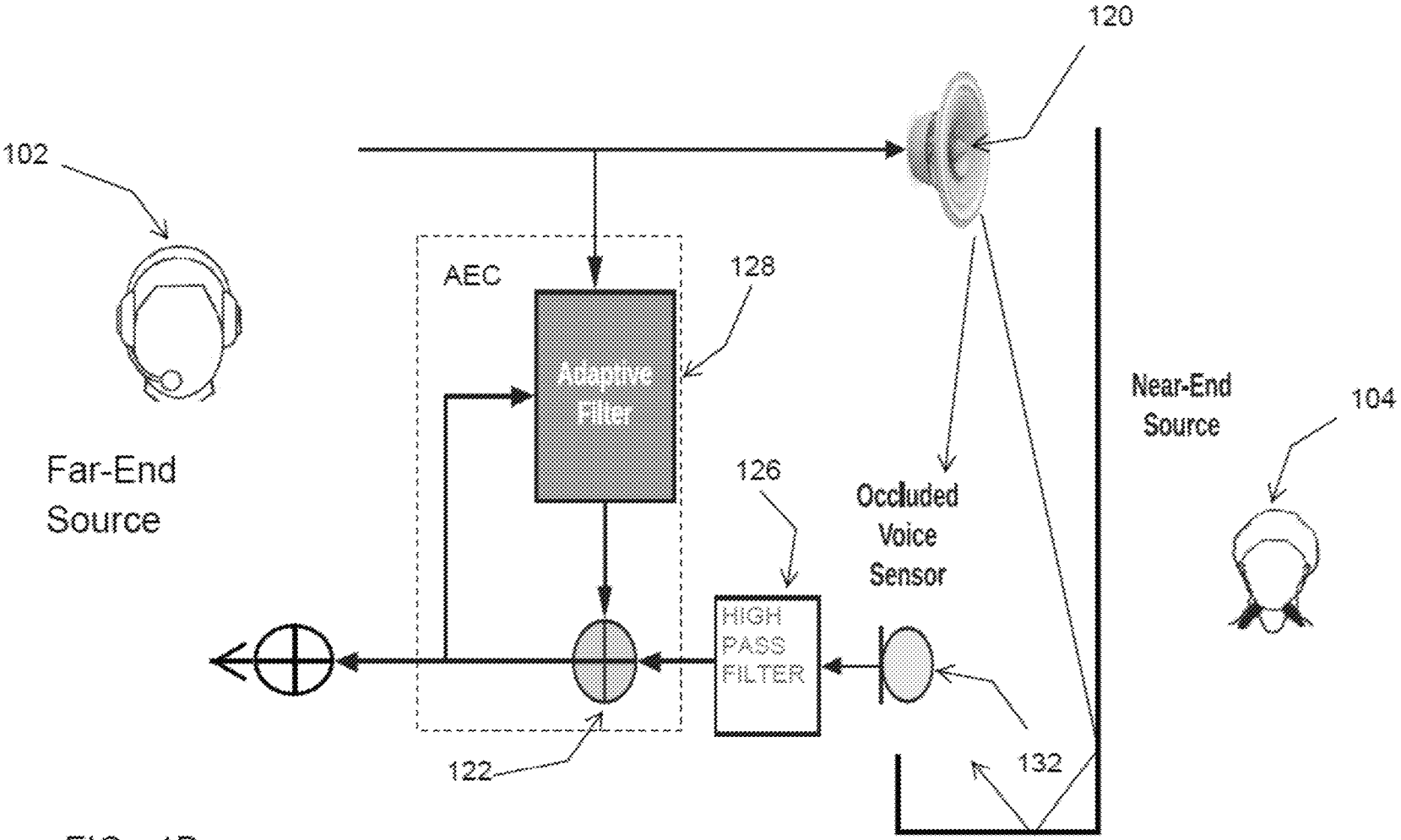
FIG. 1B is an illustration of an AEC utilizing an OVS where AEC is applied to frequencies above the occluded voice band.
Figure 1C:
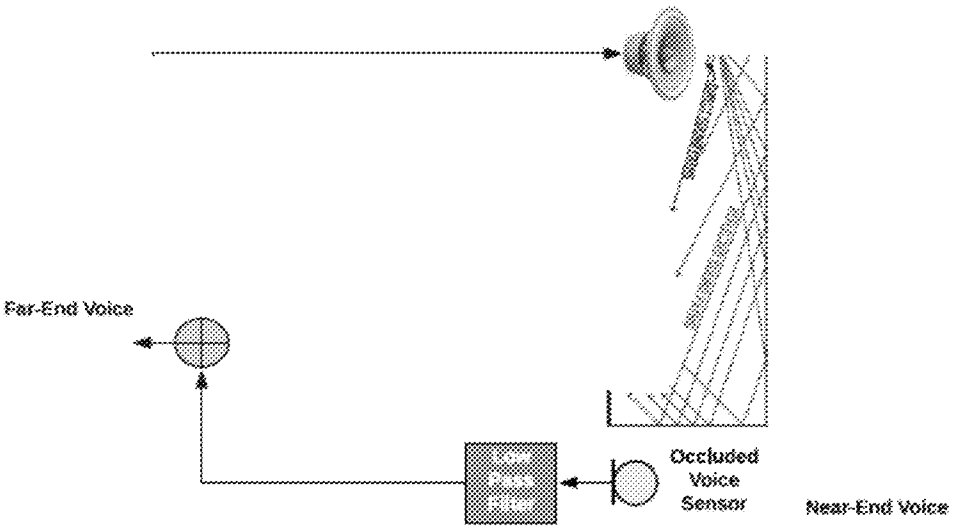
FIG. 1C is an illustration of an lower occluded voice band.
Figure 1D:
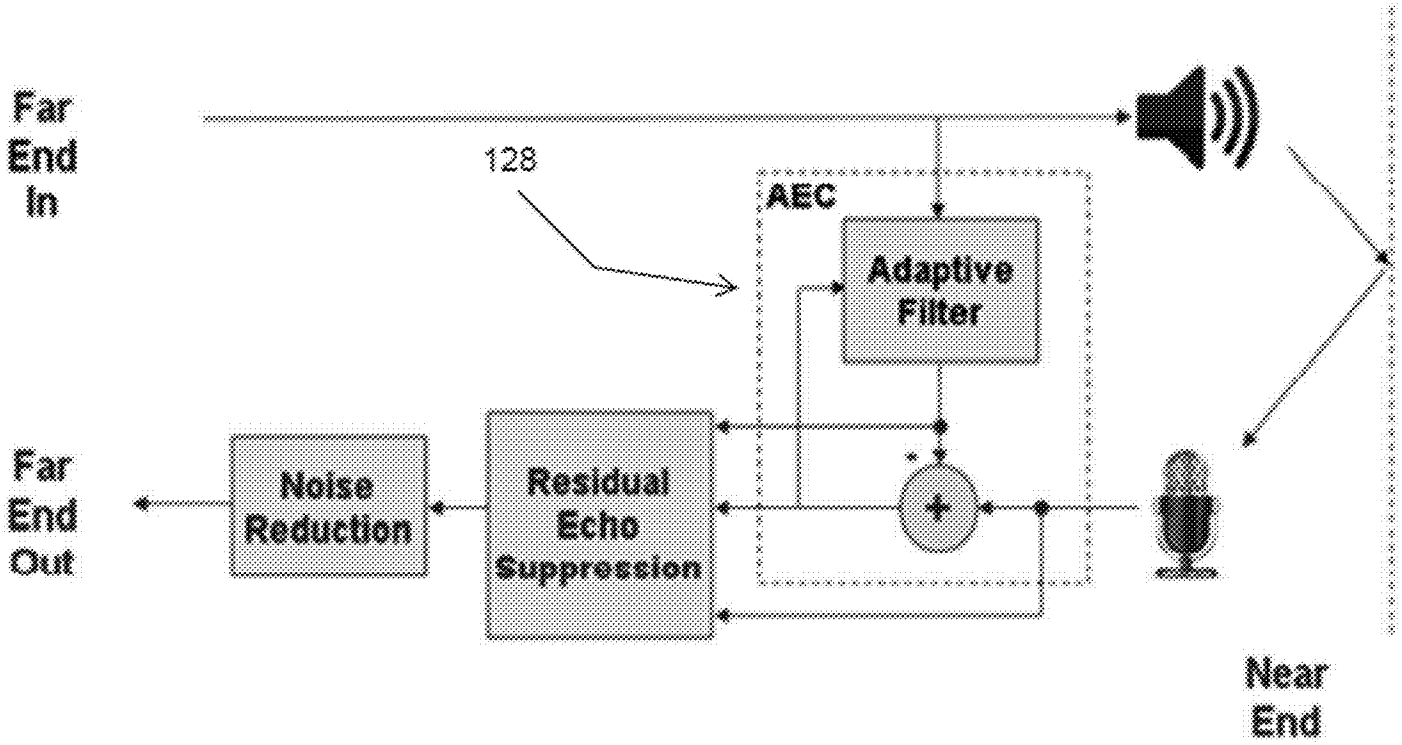
FIG. 1D is an illustration of an AEC.

One implementation of the present technology as disclosed comprising an AEC, OVS as a detector, and a low pass filter teaches an apparatus and method for an AEC utilizing an occluded voice sensor having a construction that is configured on an audio wearable to be positioned at a body-conducted voice conduction area The details of the technology as disclosed and various implementations can be better understood by referring to the figures of the drawing. Referring to FIGS. 1A and 1B, an acoustic echo cancellation system 100 is illustrated including, increasing cancellation quality and speech transmission signal-to-noise ratio (SNR) by the addition of an Occluded Voice Sensor (OVS) 132 signal added 150 to a microphone 130 signal. The Occluded Voice Sensor (OVS) 132 collects body-conducted voice instead of open-air voice, which tends to be in a lower frequency band defined as the OVS Band. Some audio wearable technologies have one or more additional sensors to capture the occluded voice. Some audio wearable technologies have one or more additional sensors to capture the colluded voice. Some headphones/headsets, as illustrated being worn by a far-end user 102, have such a sensor, such as an ear-cup 106 microphone used in Feedback Active Noise Cancellation, however, greater occlusion of the ear is needed from the ear-cup for that microphone to be an occluded voice sensor as compared to an earbud technology. One implementation of the technology as disclosed and claimed herein utilizes an audio wearable device having an OVS 112 that is tightly coupled to the ear or chest or other body-conducted voice conduction area 114 such that a body conducted voice signal 140 is collected, and the device or occluded voice sensor is acoustically shielded and acoustically isolated from environmental noise, such as reflected sounds 116, emanating from an ambient acoustical area surrounding the body conduction area 114 such that adequate Signal-to-Noise Ratio is achieve. The technology as disclosed and claimed herein and the various implementations and embodiments improves Acoustic Echo Cancellation (AEC) system performance by increasing cancellation quality and speech transmission signal-to-noise ratio (SNR) by the addition of an Occluded Voice Sensor (OVS) signal 140. The Occluded Voice Sensor (OVS) 132 collects body-conducted voice, which tends to be in a lower frequency band, instead of open-air voice, which is typically of a higher frequency with respect to body-conducted voice and is typically captured by an external open air microphone 108.

There are various OVS 132 implementations including a 1-D or 3D accelerometer in an Ear Bud 110, for example, that collects body-conducted voice signals from the ear canal's surface or in a Neck Band 112 that collects body-conducted voice from the surface of the torso of a wearer of the audio wearable device. One implementation of an OVS includes a miniature microphone in a Closed-Back Headphone's Ear Cups 106 or tight-fit Ear Bud's stem that collects the body-conducted voice that leaks into the air enclosed in the ear canal. For these various implementations, the OVS signal is shielded from environmental noise to the amount of the acoustic isolation of its enclosure, including noise generated by wind turbulence at the microphone ports. However, the OVS sensor still receives the noise that vibrates the enclosure—which is usually lower frequency noise. Another implementation of the OVS sensor is an ear canal microphone in an earbud 110 with a tight or occluded fit. This seal in an ear canal microphone, for one implementation, provides about 25 dBA attenuation above approximately 300 Hz, but more attenuation at higher frequencies. In an earbud, this OVS signal is shielded from the environment by the ear anatomy and the earbud itself.

The speech transmission path is directly improved by the replacement of a portion of the air-conducted voice signal 142 from the outward-facing microphone 130 with the noise-shielded OVS signal. The OVS signal 140 occupies the OVS Band, of the speech transmission channel while the air-conducted signal 142 occupies the channel above the OVS Band. The OVS is shielded from environmental noise, including far-end speech from the nearby speaker driver, so the AEC path then does not include components below 1000 Hz. For one implementation, the AEC algorithm/module 128 is configured to operate above 1000 Hz only. Since the AEC path bandwidth is reduced, the AEC quality is improved.

The Acoustic Echo Cancellation (AEC) 128 block is designed to remove echoes, reverberation, and unwanted added sounds from a signal that passes through an acoustic space such as direct sound paths 118 and reflected sound paths 116. As shown, the sound 154 coming from the remote person 102 speaking, known as the far-end, is sent in parallel to a signal processing path and to an acoustic path. The acoustic path consists of an amplifier/loudspeaker 120, an acoustic environment, and a microphone 130 returning the signal for signal processing. The algorithm continuously adapts this filter to model the acoustic path. The output of the filter is then subtracted from the acoustic path signal to produce a "clean" signal output with the linear portion of acoustic echoes largely removed. The AEC block also calculates a residual signal containing nonlinear acoustic artifacts. This signal is sent to a Residual Echo Cancellation block (RES) 156, See FIG. 1D, that further recovers the input signal. The signal is then (optionally) passed through a noise reduction function 158 to produce the output, which is a known as the "Far End Out.". The filter pauses adaptation when it detects sounds in the acoustic path unrelated to the far end in. This allows sounds in to be added to the far end out. For example, in the case of a hands-free system or speakerphone, adaptation pauses when a person speaks directly into the microphone. The person at the far end hears only the local talker and not the echoes and reverberation from the far end in the near end space.

The signal of speech transmission path 144 is directly improved by the replacement of a lower frequency bandwidth portion of the air-conducted voice signal sourced from the outward-facing microphones 130 with the signal from the noise-shielded OVS signal path 146. A lower frequency bandwidth portion of the air-conducted voice signal sourced from the outward-facing microphone 130 is filtered 124 out and removed. For one implementation, the lower frequency bandwidth portion that is removed 124 is a frequency portion that is defined as the OVS Band. The lower frequency band that is removed is replaced by the OVS signal when the OVS signal is combined 150 with the modulated air-conducted voice signal. For one implementation, the OVS signal is also bandwidth limited 126 to a band below approximately 1000 Hz. The OVS signal occupies the OVS Band of the speech transmission channel (frequency band) while the filter modulated air-conducted signal occupies the channel above the OVS Band.

The filter modulated air-conducted signal and the OVS signal are combined 122 and the combined signal is process by the AEC. The OVS is shielded from environmental noise, including far-end speech from the nearby speaker driver, so the AEC path then does not include components in the OVS Band. The AEC algorithm operates above the OVS Band only by adjusting the parameters of the adaptive filter. Since the AEC path bandwidth is reduced, the AEC quality is improved. For one implementation, an OVS is used to confirm the presence of user's "local voice" to freeze/unfreeze Acoustic Echo Cancellation (AEC) adaptation in double-talk situations— SEE FIG. 1B. This ensures that environmental speech is not confused with local speech. If the OVS is activated by receiving a user's "local voice" (The user's body conducted voice), then the OVS signal is combined with the bandwidth limited air-conducted voice signal and the AEC parameters are adapted with the adaptive filter such that the AEC algorithm operates above the OVS Band only. Since the OVS can help detect a wearer's voice while also rejecting nearby voices in the environment, the Double Talk condition can be identified more reliably with an OVS Voice Activity Detector (VAD) used instead or in combination with a DSP VAD. Also, since the OVS Band of the speaker's signal is not included in the Near-End 104 talker's microphone's output signal, the distortion specifications e.g. THD of the speaker driver can be relaxed.

For one implementation an OVS 132 is used to confirm the presence of user's "local voice" to freeze/unfreeze Acoustic Echo Cancellation (AEC) adaptation in double-talk or full duplex communication situations where the near-end and far-end users are speaking at the same time. Acoustic echo cancellers (AEC) are used in full-duplex hands-free communication systems in which the far-end (loudspeaker) signal is coupled with the near-end (microphone) signal. AECs are used to remove the unwanted echoes from the microphone signal. Cancellation of these echoes is a system identification signal processing problem. In this situation the microphone signal is considered the desired signal and the loudspeaker signal is the excitation signal. An adaptive filter algorithm modifies the filters coefficients, so when it is convolved with the excitation signal, it's output matches that of the microphone signal.

The difference between the near-end signal and the filter output is used as the criteria for updating the filter coefficients. In a full-duplex conversation, the presence of signals other than the far-end signal convolved with the echo path, inhibit the ability of the adaptive algorithm to model the system. Ambient noise provides a theoretical bound on the achievable cancellation of the system. The presence of the near-end 104 talker during far-end speech is a source of disruption in the adaptation of the filter. Therefore, adaptation of the filter must be prevented during this double-talk (DT) scenario via a double-talk detector. This ensures that environmental speech is not confused with local speech. When the OVS is utilized to confirm the presence of a user's "local voice" the detection causes the system to adapt thereby reducing the system's AEC path bandwidth by above ~1000 Hz. As a result, system components such as the speaker driver can be designed with less stringent distortion requirements.

Since the OVS can help detect a wearer's voice while also rejecting nearby voices in the environment, the Double Talk condition can be identified more reliably with an OVS Voice Activity Detector (VAD) 132 used instead or in combination with a DSP VAD. Since the lower 1000 Hz of the speaker's signal is not included in the Near-End talker's microphone's output signal, the distortion specifications e.g. THD of the speaker driver can be relaxed. If an audio wearable has an OVS, the technology as disclosed and claimed can run as a DSP software-only feature. The Occluded Voice Sensor (OVS) reduces a system's AEC path bandwidth by above 1000 Hz. As a result, system components such as the speaker driver can be designed with less stringent distortion requirements.

When the OVS is utilized to confirm the presence of a user's "local voice" the detection causes the system to adapt thereby reducing the system's AEC path bandwidth by above ~1000 Hz. As a result, system components such as the speaker driver can be designed with less stringent distortion requirements. A high-pass 124 filter can be utilized to provide a bandwidth limited microphone signal above the OVS Band. The OVS signal occupies the OVS Band of the speech transmission channel while the air-conducted signal occupies the channel from 1000 Hz and upward. The OVS is shielded from environmental noise, including far-end speech from the nearby speaker driver, so the AEC path then does not include components in the OVS Band. The AEC algorithm selectively operates above the OVS Band only. Since the AEC path bandwidth is reduced, the AEC quality is improved.

For one implementation of the technology as disclosed and claimed an occluded voice sensor 132 having a construction that is configured on an audio wearable to be positioned at a body-conducted voice conduction area 114 such that a body-conducted voice signal 140 is collected, and said occluded voice sensor is configured to be acoustically shielded and acoustically isolated from environmental noise emanating from the ambient acoustical area surrounding the body conduction area 114 when the occluded voice sensor is positioned at the body-conducted voice conduction area, where said occluded voice sensor is coupled with a low pass filter 126 to thereby output a bandwidth limited body conducted voice noise-shielded signal in a frequency band that doesn't extend above a predetermined frequency.

One implementation of the technology includes an outward-facing microphone 130 configured on the audio wearable to be positioned at an air-conducted voice signal area such that an air-conducted voice signal 142 is received when positioned at an air-conducted voice signal area, and where said outward facing microphone is coupled with a high-pass filter 124 to thereby output a bandwidth limited air-conducted voice signal in a frequency band that doesn't extend below the predetermined frequency. A mixing module 150 that combines the bandwidth limited body conducted voice signal and the bandwidth limited air-conducted voice signal and said mixing module thereby outputs a combined single modulated signal. One implementation of the technology includes an acoustic echo cancellation module having an AEC function 128 that operates on the combined single modulated signal at the predetermined frequency and above. The AEC function includes an adaptive filter controlled by variable control parameters to thereby control the AEC function to selectively operate when the air-conducted voice signal is present and within select bandwidths. For one implementation, the construction and disposition of the occluded voice sensor provides about approximately 25 dBA attenuation for signals above 300 Hz. For one implementation, the occluded voice sensor 132 performs a near-end voice activated detector function that selectively controls operation of the acoustic echo cancellation module/algorithm 128. For one implementation, the occluded voice sensor 132 is one or more of an accelerometer in an ear bud, a neck band 114, as illustrated, and a microphone in closed back ear-cups.

One implementation of the technology as disclosed and claimed is a method for acoustic echo cancellation utilizing an occluded voice sensor that performs the process of configuring and occluded voice sensor on an audio wearable to be positioned at a body-conducted voice conduction area and collecting a body-conducted voice signal, while acoustically shielding and acoustically isolating the occluded voice sensor from environmental noise emanating from the ambient acoustical area surrounding the body conduction area 114 when the occluded voice sensor is positioned at the body-conducted voice conduction area, and coupling a low-pass filter 126 with the occluded voice sensor 132, thereby outputting a bandwidth limited body conducted voice noise-shielded signal 160 in a frequency band that doesn't extend above a predetermined frequency. For one implementation the process includes configuring an outward-facing microphone on the audio wearable and positioning the outward facing microphone 130 at an air-conducted voice signal area and receiving an air-conducted voice signal when positioned at an air-conducted voice signal area, and coupling a high-pass filter 124 with an outward facing microphone 130, thereby outputting a bandwidth limited air-conducted voice signal 162 in a frequency band that doesn't extend below the predetermined frequency. For one implementation the process includes combining with a mixing module 150 the bandwidth limited body conducted voice signal and the bandwidth limited air-conducted voice signal and with said mixing module thereby outputting a combined single modulated signal, and operating an acoustic echo cancellation module having an AEC function that is operating at the predetermined frequency and above. For one implementation, the process includes controlling the AEC function to selectively operate when an air-conducted voice signal is present based on detection by the OVS.

The various implementations and examples shown above illustrate a method and system for AEC utilizing an OVC. A user of the present method and system may choose any of the above implementations, or an equivalent thereof, depending upon the desired application. In this regard, it is recognized that various forms of the subject AEC method and system could be utilized without departing from the scope of the present technology and various implementations as disclosed.

As is evident from the foregoing description, certain aspects of the present implementation are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the and scope of the present implementation(s). Accordingly, the specification and drawings are to be regarded in an illustrative rather than a restrictive sense.

Certain systems, apparatus, applications or processes are described herein as including a number of modules. A module may be a unit of distinct functionality that may be presented in software, hardware, or combinations thereof.

By way of illustration, the AEC function is implemented by one or more of software and hardware. When the functionality of a module is performed in any part through software, the module includes a computer-readable medium. The modules may be regarded as being communicatively coupled. The inventive subject matter may be represented in a variety of different implementations of which there are many possible permutations.

The methods described herein do not have to be executed in the order described, or in any particular order. Moreover, various activities described with respect to the methods identified herein can be executed in serial or parallel fashion. In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separate embodiment.

In an example implementation, the machine operates as a standalone device or may be connected (e.g., networked) to other machines. In a networked deployment, the machine may operate in the capacity of a server or a client machine in server-client network environment, or as a peer machine in a peer-to-peer (or distributed) network environment. The machine may be a server computer, a client computer, a personal computer (PC), a tablet PC, a set-top box (STB), a Personal Digital Assistant (PDA), a cellular telephone, a web appliance, a network router, switch or bridge, or any machine capable of executing a set of instructions (sequential or otherwise) that specify actions to be taken by that machine or computing device. Further, while only a single machine is illustrated, the term "machine" shall also be taken to include any collection of machines that individually or jointly execute a set (or multiple sets) of instructions to perform any one or more of the methodologies discussed herein.

The example computer system and client computers can include a processor (e.g., a central processing unit (CPU) a graphics processing unit (GPU) or both), a main memory and a static memory, which communicate with each other via a bus. The computer system may further include a video/graphical display unit (e.g., a liquid crystal display (LCD) or a cathode ray tube (CRT)). The computer system and client computing devices can also include an alphanumeric input device (e.g., a keyboard), a cursor control device (e.g., a mouse), a drive unit, a signal generation device (e.g., a speaker) and a network interface device.

The drive unit includes a non-transitory computer-readable medium on which is stored one or more sets of instructions (e.g., software) embodying any one or more of the methodologies or systems described herein. The software may also reside, completely or at least partially, within the main memory and/or within the processor during execution thereof by the computer system, the main memory and the processor also constituting computer-readable media. The software may further be transmitted or received over a network via the network interface device.

The term "computer-readable medium" should be taken to include a single medium or multiple media (e.g., a centralized or distributed database, and/or associated caches and servers) that store the one or more sets of instructions. The term "computer-readable medium" shall also be taken to include any medium that is capable of storing or encoding a set of instructions for execution by the machine and that cause the machine to perform any one or more of the methodologies of the present implementation. The term "computer-readable medium" shall accordingly be taken to include, but not be limited to, solid-state memories, and optical media, and magnetic media.

The various AEC implementation utilizing an OVC shown above illustrate an apparatus and method for an audio wearable with improved AEC functionality. A user of the present technology as disclosed may choose any of the above AEC and OVC, or an equivalent thereof, depending upon the desired application. In this regard, it is recognized that various forms of the subject technology as disclosed and claimed could be utilized without departing from the scope of the present invention.

As is evident from the foregoing description, certain aspects of the present technology as disclosed are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the scope of the present technology as disclosed and claimed.

Other aspects, objects and advantages of the present technology as disclosed can be obtained from a study of the drawings, the disclosure and the appended claims.

What is claimed is:

1. An acoustic echo cancellation system comprising:

an occluded voice sensor having a construction that is mounted on an audio wearable at an occluded voice sensor position such that when the audio wearable is worn, said occluded voice sensor is disposed to be positioned at a body-conducted voice conduction area such that a body-conducted voice signal is collected, and said occluded voice sensor position is located such that the occluded voice sensor is acoustically shielded and acoustically isolated from environmental noise in an ambient acoustical area surrounding the body-conducted voice conduction area when the occluded voice sensor is positioned at the body-conducted voice conduction area, where said occluded voice sensor is coupled with a low pass filter to thereby output a bandwidth limited body conducted voice signal in a frequency band that doesn't extend above a predetermined frequency;

an outward-facing microphone mounted on the audio wearable positioned at an air-conducted voice signal area such that an air-conducted voice signal is received when the audio wearable is worn, and where said outward facing microphone is coupled with a high-pass filter to thereby output a bandwidth limited air-conducted voice signal in a frequency band that doesn't extend below the predetermined frequency;

an acoustic echo cancellation module having an AEC function that operates on the bandwidth limited air-conducted voice signal at the predetermined frequency and above, and not on the bandwidth limited body conducted voice signal, to generate a processed bandwidth limited air-conducted voice signal; and a mixing module that combines the bandwidth limited body conducted voice signal and the processed bandwidth limited air-conducted voice signal and said mixing module thereby outputs a combined single modulated signal.

2. The acoustic echo cancellation system as recited in claim 1, where the AEC function includes an adaptive filter controlled by variable control parameters to thereby control the AEC function to selectively operate when the air-conducted voice signal is present based on the body conducted voice signal received at the occluded voice sensor and operate within select bandwidths.

3. The acoustic echo cancellation system as recited in claim 2, where the construction and disposition of the occluded voice sensor provides about approximately 25 dBA attenuation for signals above 300 Hz.

4. The acoustic echo cancellation system as recited in claim 3, where the occluded voice sensor performs a voice activated detector function that selectively controls operation of the acoustic echo cancellation function.

5. The acoustic echo cancellation system as recited in claim 3, where the occluded voice sensor is one or more of an accelerometer in an ear bud, a neck band and a microphone in closed back ear-cups.

6. A method for acoustic echo cancellation utilizing an occluded voice sensor comprising:

receiving, from an occluded voice sensor on an audio wearable positioned at a body-conducted voice conduction area, a body-conducted voice signal, while acoustically shielding and acoustically isolating the occluded voice sensor from environmental noise in an ambient acoustical area surrounding the body-conducted voice conduction area;

low-pass filtering the body-conducted voice signal to generate a bandwidth limited body conducted voice signal in a frequency band that doesn't extend above a predetermined frequency;

receiving, from an outward-facing microphone on the audio wearable an air-conducted voice signal;

high-pass filtering the air-conducted voice signal to generate a bandwidth limited air-conducted voice signal in a frequency band that doesn't extend below the predetermined frequency;

performing an acoustic echo cancellation (AEC) function on the bandwidth limited air-conducted voice signal at the predetermined frequency and above, and not on the bandwidth limited body conducted voice signal, to generate a processed bandwidth limited air-conducted voice signal; and combining the bandwidth limited body conducted voice signal and the processed bandwidth limited air-conducted voice signal to generate a combined single modulated signal.

7. The method of acoustic echo cancellation as recited in claim 6, where the AEC function includes an adaptive filter controlled by variable control parameters thereby controlling the AEC function to selectively operate when the air-conducted voice signal is present based on the body conducted voice signal received at the occluded voice sensor and operate within select bandwidths.

8. The method of acoustic echo cancellation as recited in claim 7, where the construction and disposition of the occluded voice sensor provides about approximately 25 dBA attenuation or greater for signals at and above 300 Hz.

9. The method of acoustic echo cancellation as recited in claim 8, where the occluded voice sensor performs a voice activated detector function that selectively controls operation of the acoustic echo cancellation.

10. The method of acoustic echo cancellation as recited in claim 9, where the occluded voice sensor is one or more of an accelerometer in an ear bud, a neck band and a microphone in closed back ear-cups.

11. A non-transitory computer-readable media having computer readable instructions stored thereon whereby a computer executes the computer readable instructions to perform a process comprising:

receiving, from an occluded voice sensor on an audio wearable positioned at a body-conducted voice conduction area, a body-conducted voice signal, the occluded voice sensor being acoustically shielded and isolated from environmental noise in an ambient acoustical area;

low-pass filtering the body-conducted voice signal to generate a bandwidth limited body conducted voice signal in a frequency band that doesn't extend above a predetermined frequency;

receiving an air-conducted voice signal from an outward facing microphone;

high-pass filtering the air-conducted voice signal to generate a bandwidth limited air-conducted voice signal in a frequency band that doesn't extend below the predetermined frequency;

performing an acoustic echo cancellation (AEC) on the bandwidth limited air-conducted voice signal at the predetermined frequency and above, and not on the bandwidth limited body conducted voice signal, to generate a processed bandwidth limited air-conducted voice signal; and combining the bandwidth limited body conducted voice signal and the processed bandwidth limited air-conducted voice signal to generate a combined single modulated signal.

12. The non-transitory computer-readable media as recited in claim 11, where the AEC is performed using an adaptive filter controlled by variable control parameters thereby controlling the AEC to selectively operate when the air-conducted voice signal is present based on the body conducted voice signal received at the occluded voice sensor and operate within select bandwidths.

13. The non-transitory computer-readable media as recited in claim 12, where the construction and disposition of the occluded voice sensor provides about approximately 25 dBA attenuation or greater for signals at and above 300 Hz.

14. The non-transitory computer-readable media as recited in claim 13, where the occluded voice sensor performs a voice activated detector function that selectively controls operation of the acoustic echo cancellation.

15. An acoustic echo cancellation system comprising:

an occluded body-conducted voice sensor configured to be acoustically shielded and acoustically isolated from environmental noise, where said occluded voice sensor is coupled with a low pass filter to thereby output a bandwidth limited body-conducted voice signal in a frequency band that doesn't extend above a predetermined frequency;

an outward-facing microphone configured with a high-pass filter to thereby output a bandwidth limited air-conducted voice signal in a frequency band that doesn't extend below the predetermined frequency;

an acoustic echo cancellation module having an AEC function that operates on the bandwidth limited air-conducted voice signal at the predetermined frequency and above, and not on the bandwidth limited body-conducted voice signal, to generate a processed bandwidth limited air-conducted voice signal; and a mixing module that combines the bandwidth limited body conducted voice signal and the processed bandwidth limited air-conducted voice signal and said mixing module thereby outputs a combined single modulated signal.

16. The acoustic echo cancellation system as recited in claim 15, where the AEC function includes an adaptive filter controlled by variable control parameters to thereby control the AEC function to selectively operate when the air-conducted voice signal is present based on the body conducted voice signal received at the occluded voice sensor and operate within select bandwidths.

17. The acoustic echo cancellation system as recited in claim 16, where the construction and disposition of the occluded voice sensor provides about approximately 25 dBA attenuation or greater for signals at and above 300 Hz.

18. The acoustic echo cancellation system as recited in claim 17, where the occluded voice sensor performs a voice activated detector function that selectively controls operation of the AEC function.

* * * * *